US010207415B2

(12) United States Patent
Vellekamp

(10) Patent No.: US 10,207,415 B2
(45) Date of Patent: Feb. 19, 2019

(54) MULTIFUNCTIONAL KNIFE

(71) Applicant: Isaac Vellekamp, Puyallup, WA (US)

(72) Inventor: Isaac Vellekamp, Puyallup, WA (US)

(73) Assignee: ReNu Tech Solutions, LLC, Missouri City, TX (US)

( * ) Notice: Subject to any disclaimer, the term of this patent is extended or adjusted under 35 U.S.C. 154(b) by 177 days.

(21) Appl. No.: 15/364,614

(22) Filed: Nov. 30, 2016

(65) Prior Publication Data

US 2017/0355087 A1 Dec. 14, 2017

Related U.S. Application Data

(60) Provisional application No. 62/348,592, filed on Jun. 10, 2016.

(51) Int. Cl.

| | |
|---|---|
| ***B26B 11/00*** | (2006.01) |
| ***A45F 5/02*** | (2006.01) |
| ***A62B 3/00*** | (2006.01) |

(52) U.S. Cl.

CPC ..... *B26B 11/006* (2013.01); *A45F 5/021* (2013.01); *A62B 3/005* (2013.01)

(58) Field of Classification Search

CPC ..... B26B 11/00; B26B 11/006; A45F 5/021; A62B 3/005

See application file for complete search history.

(56) References Cited

U.S. PATENT DOCUMENTS

| | | | | |
|---|---|---|---|---|
| 5,657,543 | A * | 8/1997 | Collins | A62B 3/005 30/123 |
| 8,112,894 | B2 * | 2/2012 | Caswell | A45F 5/02 224/269 |
| 8,312,580 | B2 * | 11/2012 | Lee | B26B 11/00 7/118 |
| 2009/0313765 | A1 * | 12/2009 | Krudo | B26B 1/044 7/158 |
| 2013/0174351 | A1 * | 7/2013 | Carson | B26B 9/00 7/118 |
| 2014/0096326 | A1 * | 4/2014 | Stinson | H02G 1/1204 7/107 |
| 2017/0246750 | A1 * | 8/2017 | Karchon | B26B 11/00 |

* cited by examiner

*Primary Examiner* — David B Thomas
(74) *Attorney, Agent, or Firm* — Benjamin Aaron Adler

(57) ABSTRACT

Provided are multifunctional folding knives for quick access to the blade and conveniently tool-securing accessory thereto. The knife comprises a blade and a handle pivotally connected to the blade. A cutout is disposed on a spine of the blade. Two or more holes are disposed in opposite relation around the cutout. A tool-securing accessory is removably secured on a spine of the blade. The tool-securing accessory comprises a base plate. A magnet is disposed in the base plate. A flange is disposed along a distal edge of an upper surface of the base plate and forming a concave opening. A semi-collar comprising a pair of arms is pivotally secured on the flange configured to switch between a locked position and an unlocked position. Two or more posts are perpendicularly disposed on the base plate to removably engage the two or more holes on the spine of the blade.

20 Claims, 6 Drawing Sheets

MULTIFUNCTIONAL KNIFE

CROSS-REFERENCE TO RELATED APPLICATIONS

This non-provisional application claims benefit of priority under 35 U.S.C. § 119(e) of provisional application U.S. Ser. No. 62/348,592, filed Jun. 10, 2016, the entirety of which is hereby incorporated by reference.

BACKGROUND OF THE INVENTION

Field of the Invention

The present invention generally relates to the field of knives. More specifically, the present invention relates to a multifunctional folding knife with a removable accessory configured to receive an attachment, such as a screwdriver bit.

Description of the Related Art

Folding knives have been widely used for multiple purposes such as a self-defense tool, cutting instrument etc. Many folding knives pack various tools within it. For instance, screw driver, nail filer, and wine opener, are most common tools that are foldable into the handle along with the blade. However, multiple tools folded into the handle often make it inconvenient for the users to quickly find and access the mark on the blade, or to open the correct tool from the handle especially in a situation of self-defense or other emergency.

Therefore, there is a recognized need in the art for a knife with a tool securing accessory that enables quick access to the knife and other tools and minimizes interference with the quick release of the blade. Particularly, the previous art is deficient in this aspect. The present invention fulfills this long-standing need and desire in the art.

SUMMARY OF THE INVENTION

The present invention is directed to a multifunctional knife comprising a handle and a blade pivotally secured to the handle. A tool-securing accessory is removably secured on a spine of the blade.

The present invention also is directed to a multifunctional folding knife. The folding knife comprises a knife blade and a handle pivotally connected to the blade. A cutout is disposed on a spine of the knife blade. Two or more holes are disposed in opposite relation around the cutout. A tool-securing accessory is removably secured on a spine of the knife blade. The tool-securing accessory comprises a base plate. A magnet is disposed in the base plate. A flange is disposed along a distal edge of an upper surface of the base plate and forming a concave opening. A semi-collar comprising a pair of arms is pivotally secured on the flange configured to switch between a locked position and an unlocked position. Two or more posts are perpendicularly disposed on the base plate to removably engage the two or more holes on the spine of the blade Other and further aspects, features, benefits, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be by reference to certain embodiments thereof that are illustrated in the appended drawings. These drawings form a part of the specification. It is to be noted, however, that the appended drawings illustrate preferred embodiments of the invention and therefore are not to be considered limiting in their scope.

FIG. 2A is a top view of the tool-securing accessory of the knife when the semi-collar is in the locked position. FIG. 2B is a top view of the tool-securing accessory of the knife when the semi-collar is in the unlocked position.

DETAILED DESCRIPTION OF THE INVENTION

Figure 1:
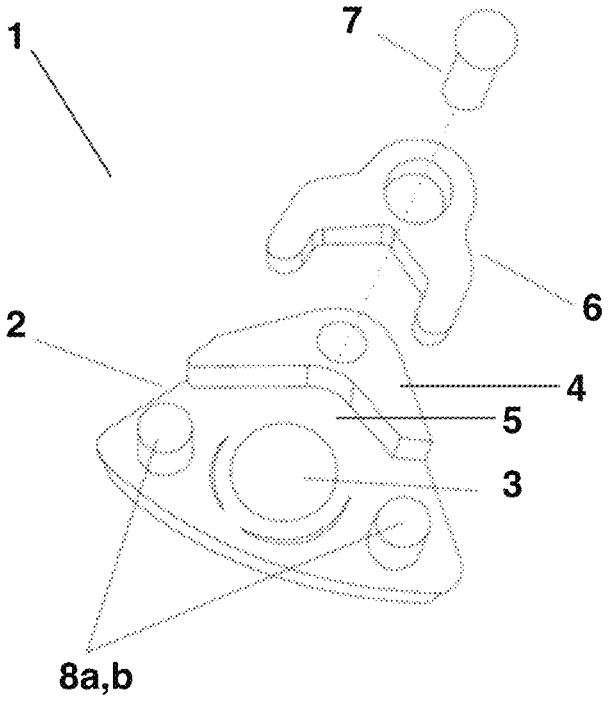
FIG. 1 is an exploded view of the tool-securing accessory of the multifunctional knife.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein the term "distal" refers to a direction that is away from the blade of the knife.

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

In one embodiment of the present invention, there is provided a multifunctional knife comprising a handle; a blade pivotally secured to the handle; and a tool-securing accessory removably secured on a spine of the blade.

In this embodiment, the blade may comprise a cutout on the spine thereof; and two or more holes disposed in opposite relation around the cutout. Also, the tool-securing accessory may comprise a base plate; a magnet disposed in the base plate; a flange disposed along a distal edge of an upper surface of the base plate and forming a concave opening; a semi-collar comprising a pair of arms pivotally secured on the flange; and two or more posts perpendicularly disposed on the base plate to removably engage the two or more holes on the spine of the blade.

Also in this embodiment, the flange may have a thickness substantially the same as the spine of the blade such that the flange and the cutout form a recess over the magnet when the posts on the base plate engage the openings on the spine of the blade, the recess is configured to receive tools and the magnet is configured to secure the tools. In a preferred embodiment, the recess is substantially hexagonal, and the tool received by the recess comprises a hexagonal sectional surface. Exemplary tools include, but are not limited to, a drill bit, a screwdriver bit, etc.

In addition to this embodiment, when in a locked position the arms of the semi-collar may encircle the cutout of the blade to secure the base plate thereto. Alternatively, in an unlocked position the arms of the locking semi-collar are pivoted 180 degrees to release the base plate from the blade.

Further to these embodiments the multifunctional knife may comprise a finger ring formed at an end of the handle of the knife. In another further embodiment, the multifunctional knife may comprise an emergency window breaker formed on an exterior surface of the finger ring. In yet another further embodiment, the multifunctional knife may comprise a plurality of screw holes disposed in alignment on each side of the knife handle configured to removably secure a belt clip thereto.

In another embodiment of the present invention, there is provided a multifunctional folding knife, comprising a handle; a blade pivotally connected to the handle; a cutout disposed on a spine of the blade; two or more holes disposed in opposite relation around the cutout; and a tool-securing accessory removably secured on a spine of the knife blade comprising a base plate; a magnet disposed in the base plate; a flange disposed along a distal edge of an upper surface of the base plate and forming a concave opening; a semi-collar comprising a pair of arms pivotally secured on the flange; and two or more posts perpendicularly disposed on the base plate to removably engage the two or more holes on the spine of the blade.

In a further embodiment of the present invention, the multifunctional folding knife may comprise a finger ring formed at an end of the handle of the knife. In another further embodiment of the present invention, the multifunctional folding knife may comprise an emergency window breaker formed on an exterior surface of the finger ring. In yet another further embodiment, the multifunctional folding knife may comprise a plurality of screw holes disposed in alignment on each side of the knife handle configured to removably secure a belt clip thereto.

In these embodiments, the flange may have a thickness substantially the same as the spine of the blade such that the flange and the cutout form a recess over the magnet when the posts on the base plate engage the openings on the spine of the blade, the recess is configured to receive tools and the magnet is configured to secure the tools. Preferably, the recess is substantially hexagonal, and the tool received by the recess comprises a hexagonal sectional surface. In these embodiments, the exemplary tools may include but are not limited to a drill bit or a screwdriver bit.

Also, in these embodiments, the arms of the semi-collar may encircle the cutout of the blade to secure the base plate thereto in a locked position. Alternatively, in an unlocked position the arms of the locking semi-collar are pivoted 180 degrees to release the base plate from the blade.

Provided herein are the tool-securing accessories and the knife for quickly accessing the knife without any interference while attaching various tools thereon. Generally, the knife comprises a blade, a cutout disposed on a spine of the blade, two or more openings disposed along the edge of the cutout, a handle pivotally connected to the blade.

As shown in FIG. 1, the tool-securing accessory 1 comprises a base plate 2, and a magnet 3 disposed in the center of the base plate. A flange 4 is disposed on a top surface of the base plate along the distal edge thereof. The flange comprises a concave opening 5 that fits a spine of the blade next to the cutout thereof and forms a recess over the magnet with the cutout of the blade (11, see FIG. 5). The flange has a thickness substantially the same as the spine of the blade. A semi-collar 6 comprising two arms 10*a,b* (see FIG. 2B) is pivotally disposed on top of the flange via a fastening tool such as a rivet 7 or a screw. Two or more connectors 8*a,b*, such as posts, are removably secured through the base plate at positions corresponding to the positions of the openings on the blade.

Figure 2A:
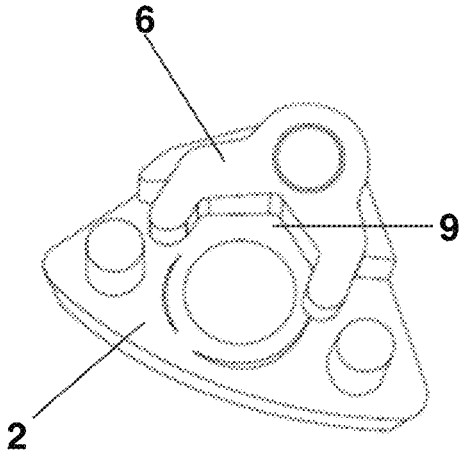
FIGS. 2A-2B are top views of the assembled tool-securing accessory for the multifunctional knife.
Figure 2B:
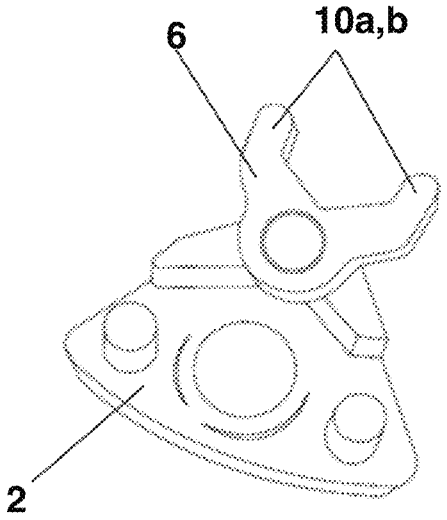

As shown in FIGS. 2A and 2B, the semi-collar 6 is rotatable around an axis that is substantially perpendicular to a plane defined by the base plate 2. Alternatively, the axis can be substantially parallel to a plane defined by the base plate. In FIG. 2A the semi-collar 6 comprises a concave opening or concavity 9 in the shape substantially the same as half of the recess over the magnet of the base plate. When it is in locked position, the concavity faces inward towards the posts. In FIG. 2B, the semi-collar is in the unlocked position where the concavity thereof faces outwardly from the base plate.

Figure 3:
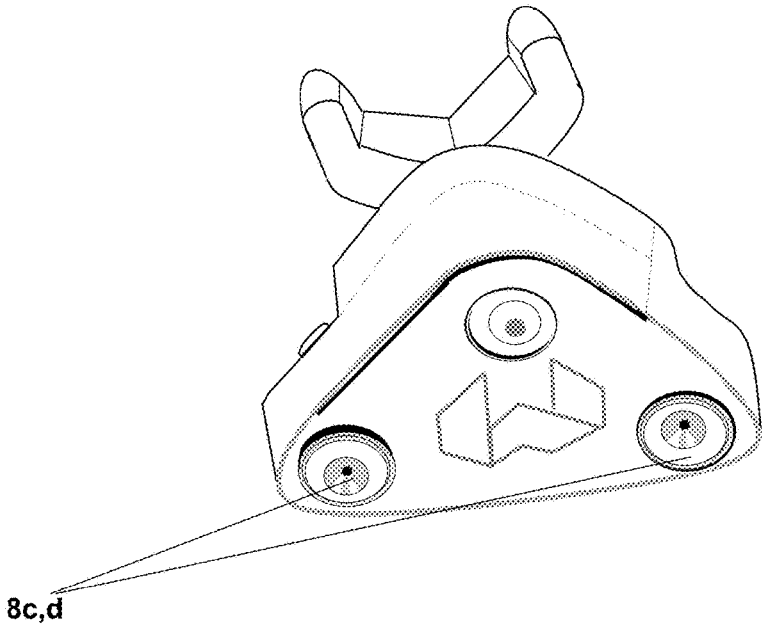
FIG. 3 is a picture of the tool-securing accessory of the knife showing a perspective view from the bottom side thereof.

FIG. 3 is a photo of the tool-securing accessory showing the back side thereof. The connector posts 8*a,b* are removably secured through the openings at 8*c,d* on the base plate on the back.

Figure 4A:
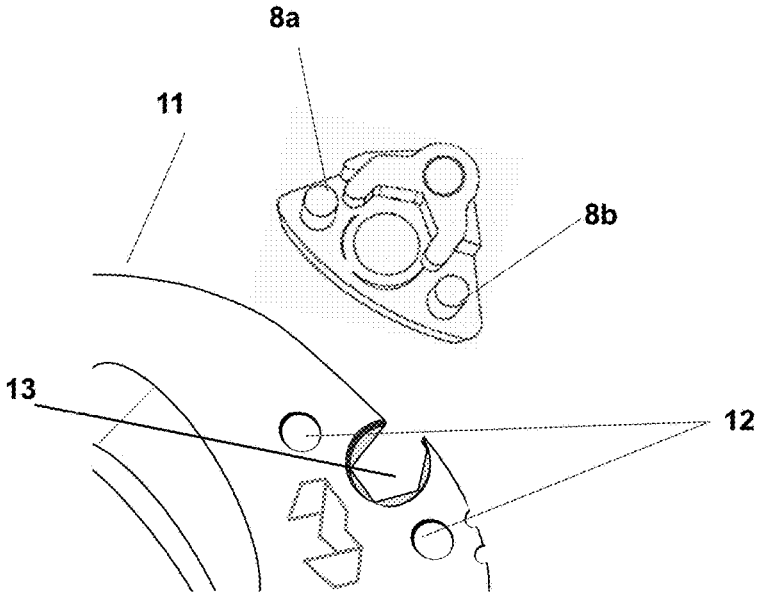
FIG. 4A is a picture of the knife showing a side by side perspective view of the tool-securing accessory and blade showing the configuration that enables securement of the accessory
Figure 4B:
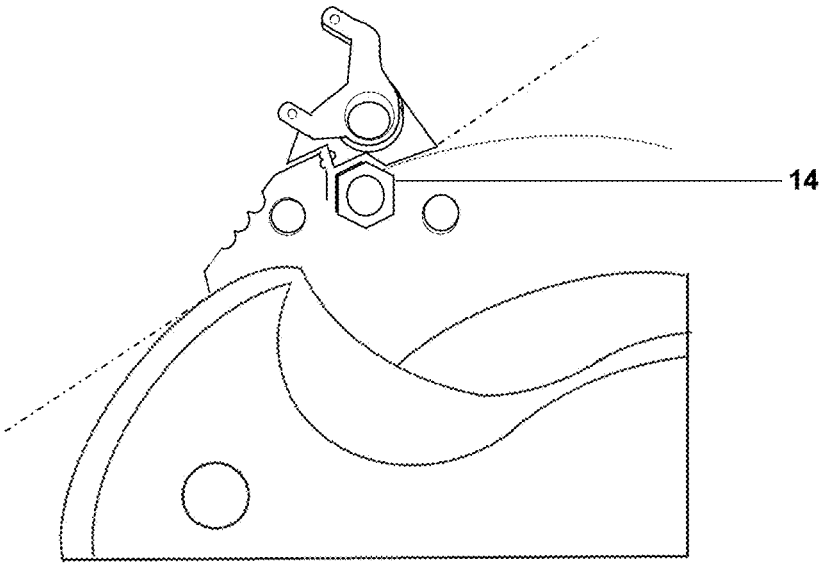
FIG. 4B shows a picture where the tool-securing accessory attached to the blade of the knife at the cutout with the semi-collar in an unlocked position, illustrating how the locking mechanism is pivoted to position the accessory on the blade.
Figure 4C:
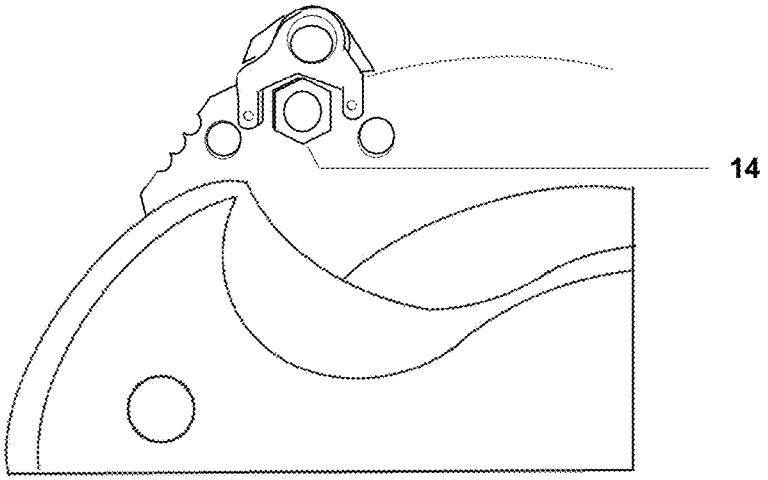
FIG. 4C shows a picture where the tool-securing accessory attached to the blade of the knife at the cutout with semi-collar in a locked position, illustrating how the tool securing accessory is secured to the blade with the locking mechanism.

FIG. 4A further depicts the tool-securing accessory disassembled from the blade 11 showing the two openings 12*a,b* disposed in opposite relation along the edge of the cutout 13 that receive the posts 8*a,b*. In FIG. 4B, the tool-securing accessory is secured to the blade of the knife with the semi-collar in an unlocked position and the posts engaged to the openings on the blade. The base plate abuts the backside of the blade over the cutout. Preferably, the thickness of the flange 4 is substantially the same as the spine of the blade. The cutout of the blade and the open side of the flange of the tool-securing accessory forms a recess 14 over the magnet of the base plate. The recess is configured to receive a tool, such as a screwdriver bit, or drill bit while the magnet is configured to secure the tool with magnetic force. Therefore, generally, the recess is substantially hexagonal. In FIG. 4C, the semi-collar 6 is in a locked position with the two arms thereof encircling the cutout. The semi-collar and the base plate clamp onto the blade of the knife, preventing the posts from moving out of the openings of the blade.

Figure 5:
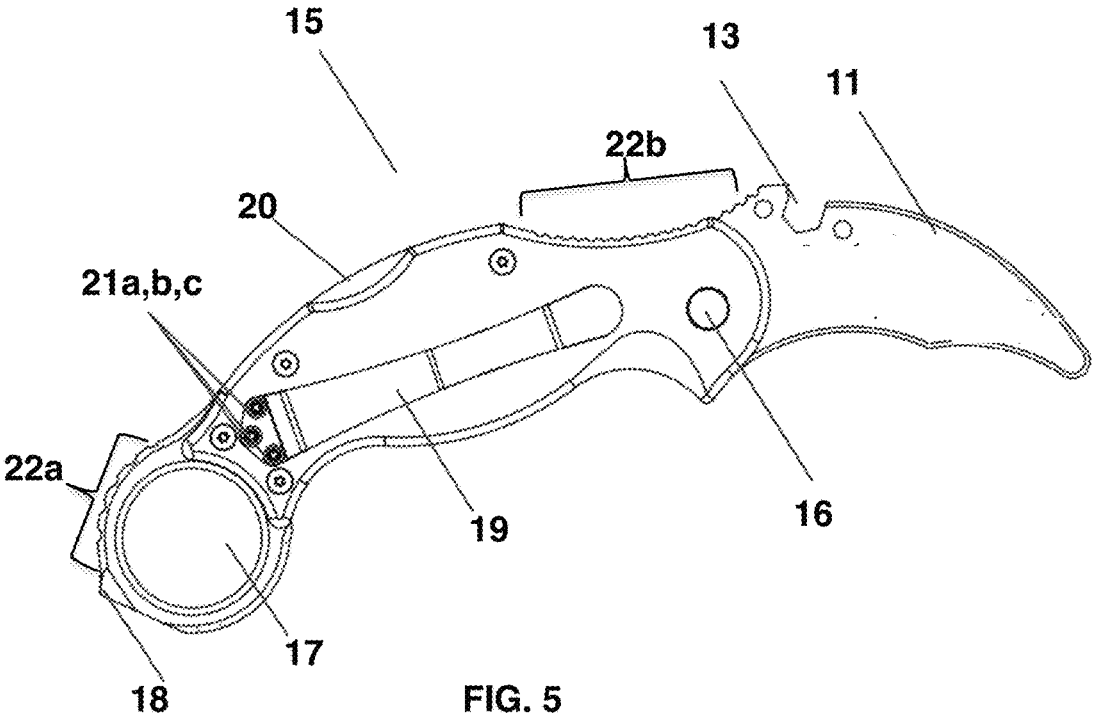
FIG. 5 is a reverse side of the knife with the belt clip attached to the handle through three screws and a finger ring formed at a distal end of the handle, showing the release to close the knife and the disposition of ridges to support a finger.

In FIG. 5, the knife 15 is preferably a folding knife. The cutout 13 is disposed on the spine of the knife such that it is proximal to the connection 16 when the blade is folded into the handle. The cutout may be any shape. However, to be compatible with most commonly used screwdriver bits or drill bits, the cutout is substantially half hexagonal. A finger ring 17 is formed at the end of the handle distal to the blade. An emergency window breaker 18 is formed on an exterior surface of the finger ring. A belt clip 19 is attached to the handle via screws 21*a,b,c*. A release bar 20 is disposed on the spine of the handle configured to release the blade of the knife from an open position when a user presses the release bar. Ridges 22*a*, 22*b* are disposed on the spine of the handle and the finger ring to improve the grip on the handle and finger ring, respectively.

Figure 6:
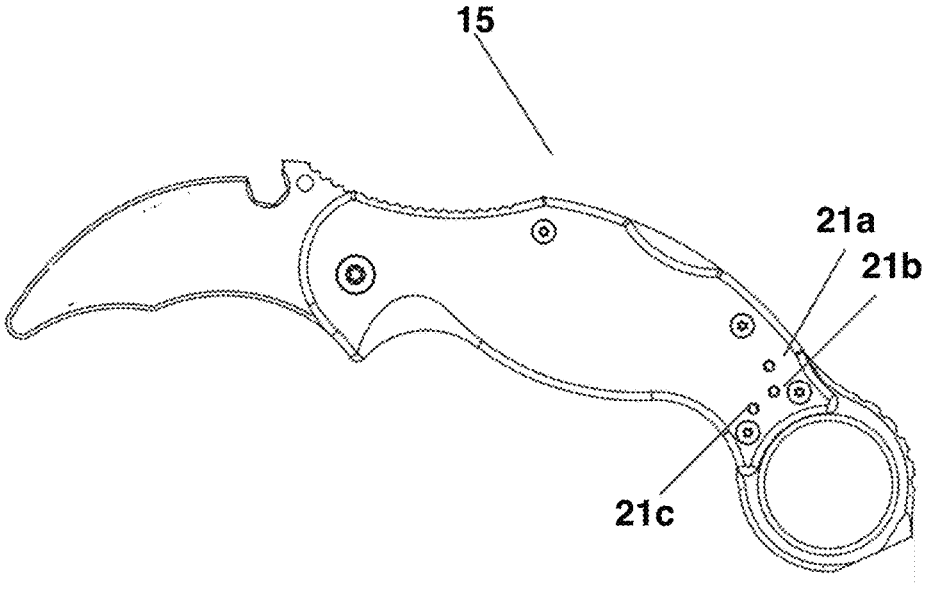
FIG. 6 is an obverse view of the knife showing no belt clip is attached to the backside of the handle. This figure shows the 3 holes corresponding to those on the other side securing the belt clip so that the belt clip can be moved for left-handed use.
Figure 7:
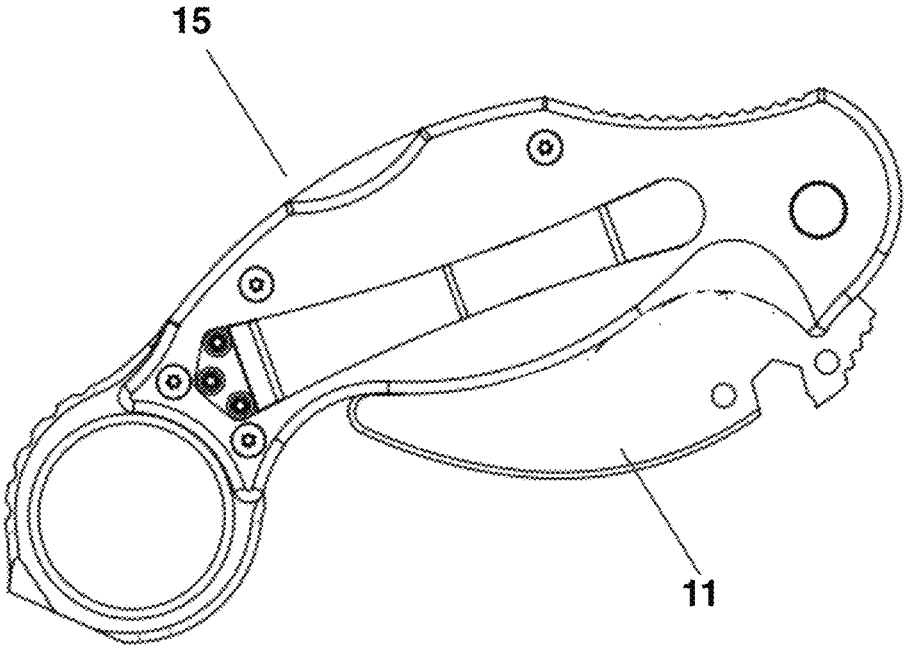
FIG. 7 is a reverse view of the knife with the blade folded into the handle thereof. This figure shows where the accessory is attached when the blade is folded, so that it doesn't interfere with the handle.

FIG. 6 illustrates that the plurality of screw holes 21*a,b,c* are disposed on both sides of the handle for attaching belt clip to either side thereby accommodating for both left handed and right handed users. FIG. 7 shows that the blade is folded into the handle of the knife.

Figure 8:
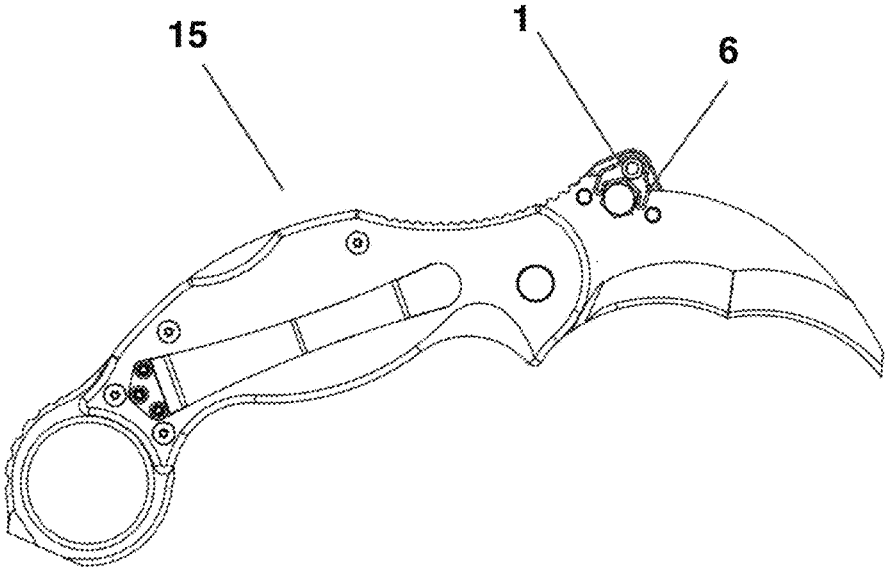
FIG. 8 is a reverse view of the knife with the tool-securing accessory attached to the blade of the knife.
Figure 9:
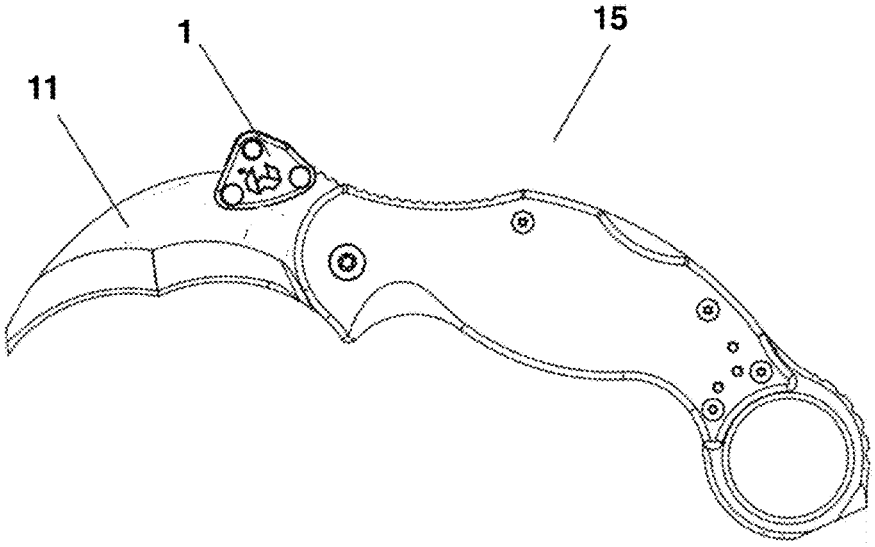
FIG. 9 is an obverse view of the knife with the tool-securing accessory attached to the blade of the knife.

FIGS. 8 and 9 show the knife 15 with the tool-securing accessory 1 secured to the blade 11 around the cutout thereof. As shown in FIG. 8, the semi-collar 6 is in the locked position. The recess over the magnet of the base plate is substantially hexagonal. FIG. 9 is the obverse view of the knife 15 showing the tool-securing accessory 1 secured onto the blade 11 showing the back of the tool-securing accessory.

The present invention is well adapted to attain the ends and advantages mentioned as well as those that are inherent therein. The particular embodiments disclosed above are illustrative only, as the present invention may be modified and practiced in different but equivalent manners apparent to those skilled in the field having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

What is claimed is:

1. A multifunctional knife comprising:
- a handle;
- a blade pivotally secured to the handle; and
- a tool-securing accessory removably secured on a spine of the blade.

2. The multifunctional knife of claim 1, wherein the blade comprises:
- a cutout on the spine thereof; and
- two or more holes disposed in opposite relation around the cutout.

3. The multifunctional knife of claim 1, wherein the tool-securing accessory comprises:
- a base plate;
- a magnet disposed in the base plate;
- a flange disposed along a distal edge of an upper surface of the base plate and forming a concave opening;
- a semi-collar comprising a pair of arms pivotally secured on the flange; and
- two or more posts disposed perpendicularly on the base plate to removably engage the two or more holes on the spine of the blade.

4. The multifunctional knife of claim 3, wherein said flange has a thickness substantially the same as the spine of the blade such that the flange and the cutout form a recess over the magnet when the posts on the base plate engage the openings on the spine of the blade, said recess configured to receive tools and said magnet configured to secure the tools.

5. The multifunctional knife of claim 4, wherein said recess is substantially hexagonal, said tool received by the recess comprising a hexagonal sectional surface.

6. The multifunctional knife of claim 4, wherein the tools are a drill bit or a screwdriver bit.

7. The multifunctional knife of claim 3, wherein when in a locked position the arms of the semi-collar encircle the cutout of the blade to secure the base plate thereto.

8. The multifunctional knife of claim 3, wherein in an unlocked position the arms of the locking semi-collar are pivoted 180 degrees to release the base plate from the blade.

9. The multifunctional knife of claim 1, further comprising a finger ring formed at an end of the handle of the knife.

10. The multifunctional knife of claim 9, further comprising an emergency window breaker formed on an exterior surface of the finger ring.

11. The multifunctional knife of claim 1, further comprising a plurality of screw holes disposed in alignment on each side of the knife handle configured to removably secure a belt clip thereto.

12. A multifunctional folding knife, comprising:
- a handle;
- a blade pivotally connected to the handle; and
- a cutout disposed on a spine of the blade;
- two or more holes disposed in opposite relation around the cutout; and
- a tool-securing accessory removably secured on a spine of the knife blade comprising:
  - a base plate;
  - a magnet disposed in the base plate;
  - a flange disposed along a distal edge of an upper surface of the base plate and forming a concave opening;
  - a semi-collar comprising a pair of arms pivotally secured on the flange; and
  - two or more posts disposed perpendicularly on the base plate to removably engage the two or more holes on the spine of the blade.

13. The multifunctional folding knife of claim 12, further comprising a finger ring formed at an end of the handle of the knife.

14. The multifunctional folding knife of claim 13, further comprises an emergency window breaker formed at an exterior surface of the finger ring.

15. The multifunctional folding knife of claim 12, further comprises a plurality of screw holes disposed on each side of the handle configured to secure a belt clip on either side thereof.

16. The multifunctional folding knife of claim 12, wherein said flange has a thickness substantially the same as the spine of the blade such that the flange and the cutout form a recess over the magnet when the posts on the base plate engage the openings on the spine of the blade, said recess is configured to receive tools and said magnet is configured to secure the tools.

17. The multifunctional folding knife of claim 16, wherein said recess is substantially hexagonal, said tool received by the recess comprising a hexagonal sectional surface.

18. The multifunctional folding knife of claim 16, wherein the tools are a drill bit or a screwdriver bit.

19. The multifunctional folding knife of claim 12, wherein in a locked position the arms of the semi-collar encircle the cutout of the blade to secure the base plate thereto.

20. The multifunctional folding knife of claim 12, wherein when in an unlocked position the arms of the locking semi-collar are pivoted 180 degrees to release the base plate from the blade.

* * * * *